United States Patent [19]

Martin

[11] Patent Number: 4,872,681

[45] Date of Patent: Oct. 10, 1989

[54] GAME APPARATUS

[76] Inventor: Michael A. Martin, P.O. Box 21686, Salt Lake City, UT 84121

[21] Appl. No.: 277,754

[22] Filed: Nov. 30, 1988

[51] Int. Cl.[4] ..... A63D 3/00

[52] U.S. Cl. ..... 273/118 R; 273/236; 273/296; 273/285

[58] Field of Search ..... 273/118 R, 236, 285, 273/296

[56] References Cited

U.S. PATENT DOCUMENTS

| | | | |
|---|---|---|---|
| 3,504,914 | 4/1970 | Bradbury | 273/118 R |
| 3,704,018 | 11/1972 | Fayanes | 273/243 |
| 4,635,939 | 1/1987 | Makow | 273/296 |
| 4,682,956 | 7/1987 | Krane | 273/243 |

FOREIGN PATENT DOCUMENTS

| | | | |
|---|---|---|---|
| 0190872 | 8/1986 | European Pat. Off. | 273/258 |
| 2126908 | 4/1984 | United Kingdom | 273/236 |

*Primary Examiner*—Edward M. Coven
*Assistant Examiner*—Gary Jackson
*Attorney, Agent, or Firm*—Larry D. Johnson

[57] ABSTRACT

A game apparatus incorporates a random result generator into the playing surface itself, and includes a game board having a perimeter, a plurality of corners, a plurality of playing sections, and a center area. A boundary extends generally around the perimeter of the playing surface, but interior of the corners. A plurality of section dividing lines, each defining a diminishing-radius curve extending from the boundary towards the center area, divide that portion of the playing surface into a plurality of playing sections, each bearing indicia corresponding to a play result. Players roll game pieces from the playing surface corners towards the playing sections, so that the game piece comes to rest on one playing section, thus generating a result indicia for that roll. The player then draws a single card from the group of cards bearing that same result indicia, and asks the question printed on that card. Each player indicates his own response to the asked question on his score pad, as well as his perception of what he thinks the other players response to that same question would be.

2 Claims, 3 Drawing Sheets

GAME APPARATUS

BACKGROUND OF THE INVENTION

1. Field of the Invention

This invention relates generally to board games and related entertainment devices, and more specifically to an improved game apparatus for generating random questions and requiring each player to formulate accurate perceptions about each of the other players.

2. Description of the Prior Art

Numerous board games have been developed which utilize random number or result generators to direct the play of the game. Typically, however, these random result generators employ dice, spinners, or other extraneous objects. In addition, no known board game requires the players to formulate perceptions about the other players in response to questions selected by such a random result generator.

SUMMARY OF THE INVENTION

The game apparatus of this invention provides a novel board game incorporating a random result generator into the playing surface itself. The game apparatus includes a game board or playing surface having a perimeter, a plurality of corners, a plurality of playing sections, and a center area. A boundary extends generally around the perimeter of the playing surface, but interior of the corners. A plurality of section dividing lines, each defining a diminishing-radius curve extending from the boundary towards the center area, divide that portion of the playing surface into a plurality of playing sections, each bearing indicia corresponding to a play result.

The game apparatus further includes a plurality of questions cards each bearing indicia indicative of only one of more than one level of questions, and a score pad to record playing information. Players place a game piece on one of the playing surface corners, and roll the game piece towards the playing sections, so that the rolled game piece comes to rest on one playing section, thus generating a result indicia for that roll. The player then draws a single card from the group of cards bearing that same result indicia, and asks the question printed on that card. Each player indicates his own response to the asked question on his score pad, as well as his perception of what he thinks the other player's response to that same question would be. Play resumes with the next player, who rolls his game piece, draws a card, asks the question indicated, and so on, until a predetermined number of questions have been asked and answered. Players then compare their results, and the player with the largest number of correct perceptions of other player's responses wins the game.

DETAILED DESCRIPTION OF A PREFERRED EMBODIMENT

Figure 1:
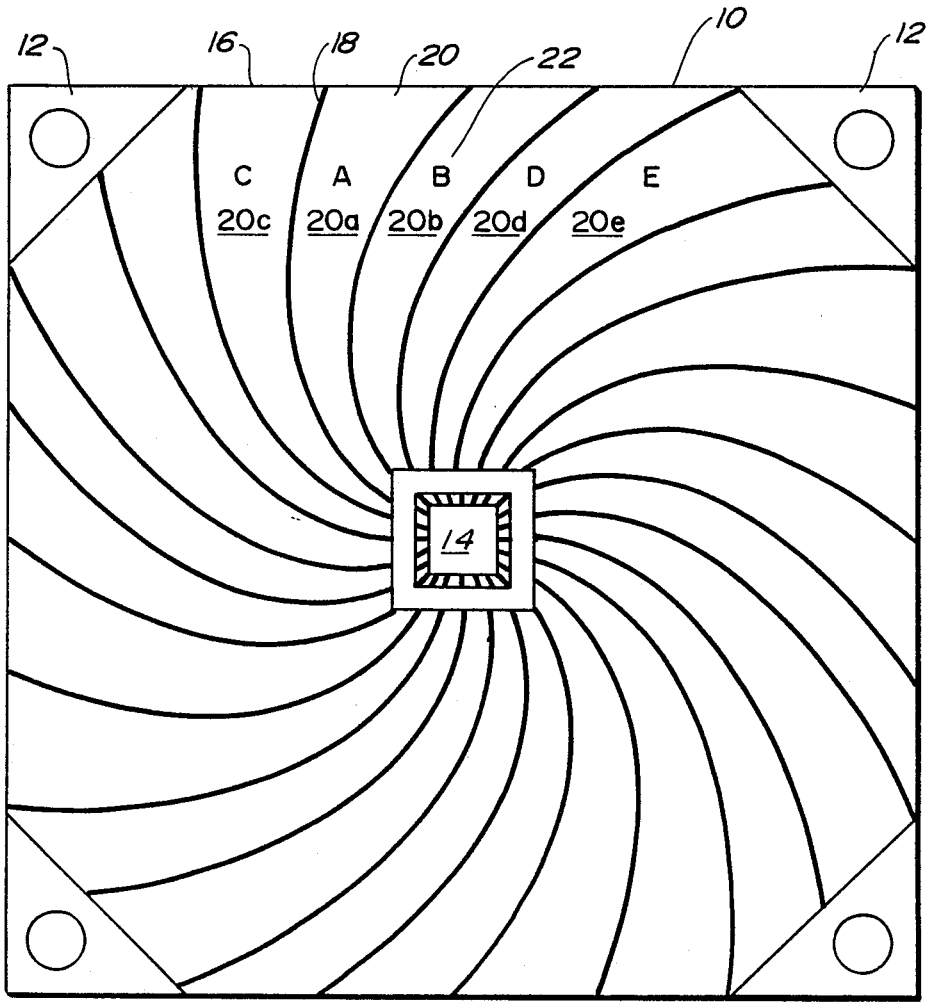
FIG. 1 is a top plan view of the game board or playing surface of the game apparatus of this invention.

FIG. 1 is a top plan view of the game board or playing surface 10 of the game apparatus of this invention.

Playing surface 10 is preferably made of cloth or other foldable material, and is of a size (e.g., eighteen inches square) to be placed in the middle of a group of players. The playing surface includes a plurality of corners 12 and a center area 14. A boundary 16 extends generally around the perimeter of the playing surface 10, but interior of the corners. A plurality of section dividing lines 18, each defining a diminishing-radius curve extending from boundary 16 towards center area 14, divide that portion of the playing surface into a plurality of playing sections 20, each bearing indicia 22 corresponding to a particular play result.

For example, in the preferred embodiment, playing sections 20 bear one of five different indicia, each indicative of a particular play result. Playing section **20*a* may include an indicia "A" or a color (e.g. burgundy) indicative of a selection from a corresponding "A" group of question cards (described infra) while playing sections 20*b*, 20*c*, 20*d*, and 20*e*** may bear indicia "B", "C", "D", and "E", or bear colors (e.g. green, blue, gold, and grey respectively) indicative of a selection from a corresponding "B" group of question cards, "C" group of question cards, any group of question cards, or no group of question cards (i.e., loss of turn), respectively.

Figure 2:
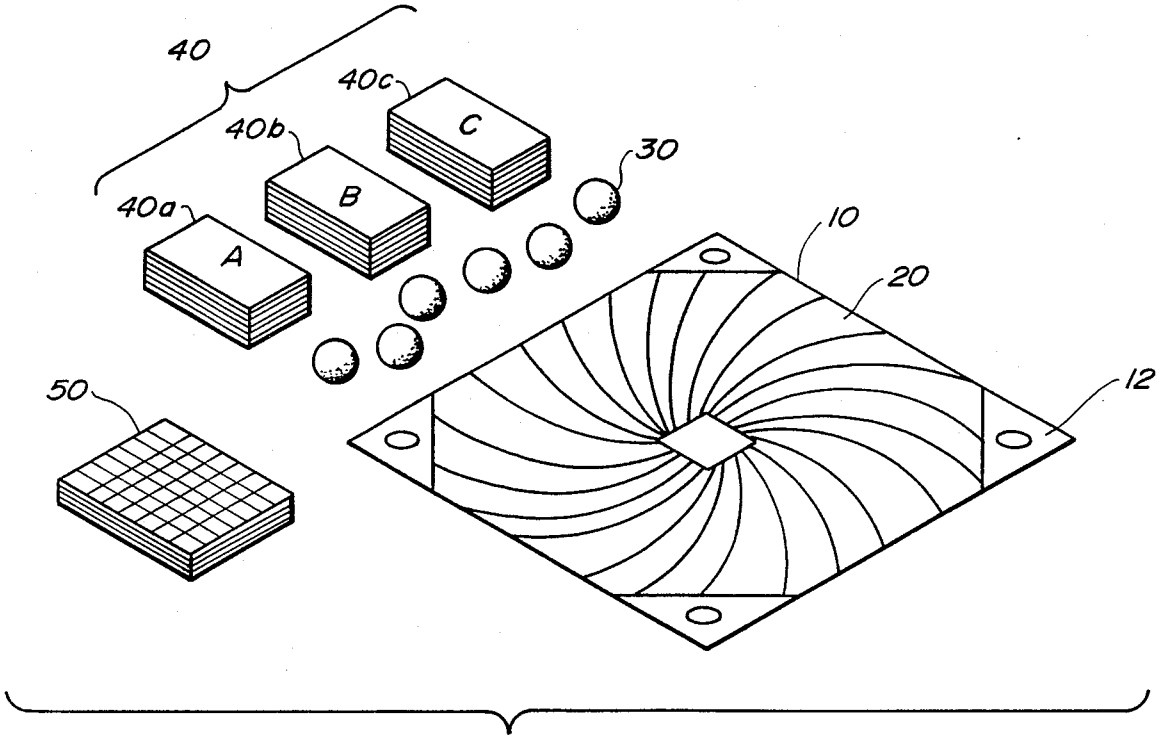
FIG. 2 is a perspective view of the components of the game apparatus of this invention, including the playing surface, game pieces, question cards, and score pad.

FIG. 2 is a perspective view of the components of the game apparatus of this invention, including the playing surface 10, game pieces 30, question cards 40, and score pad 50. Game pieces 30 preferably comprise small foam spheres of a size to be placed in the corners 12 of the playing surface and rolled toward the playing sections 20.

Question cards 40 can be subdivided into a plurality of levels of cards, **40*a*, 40*b*, and 40*c*, each bearing indicia such as "A", "B", or "C" (or the colors burgundy, green, and blue, respectively), corresponding to those indicia on the respective playing sections. These cards further bear printed questions requiring a personal response from each player. For example, questions from the first level of cards 40*a* are the simplest and most straightforward, and might include such questions as "Do you consider yourself more of a conservative or a liberal person?". Questions from the next level of question cards 40*b* are perhaps more difficult, requiring more thought, and might include questions such as "Are you more comfortable with or without a gun in the house when you're home alone?". Finally, questions from the third level of question cards 40*c*** are the most thought-provoking, dealing with personal outlooks and beliefs, and might include questions such as "If a close friend or relative asks you to perform a mercy killing, that is, taking them off of life support systems, would you feel able to carry out the request?".

Figure 3:
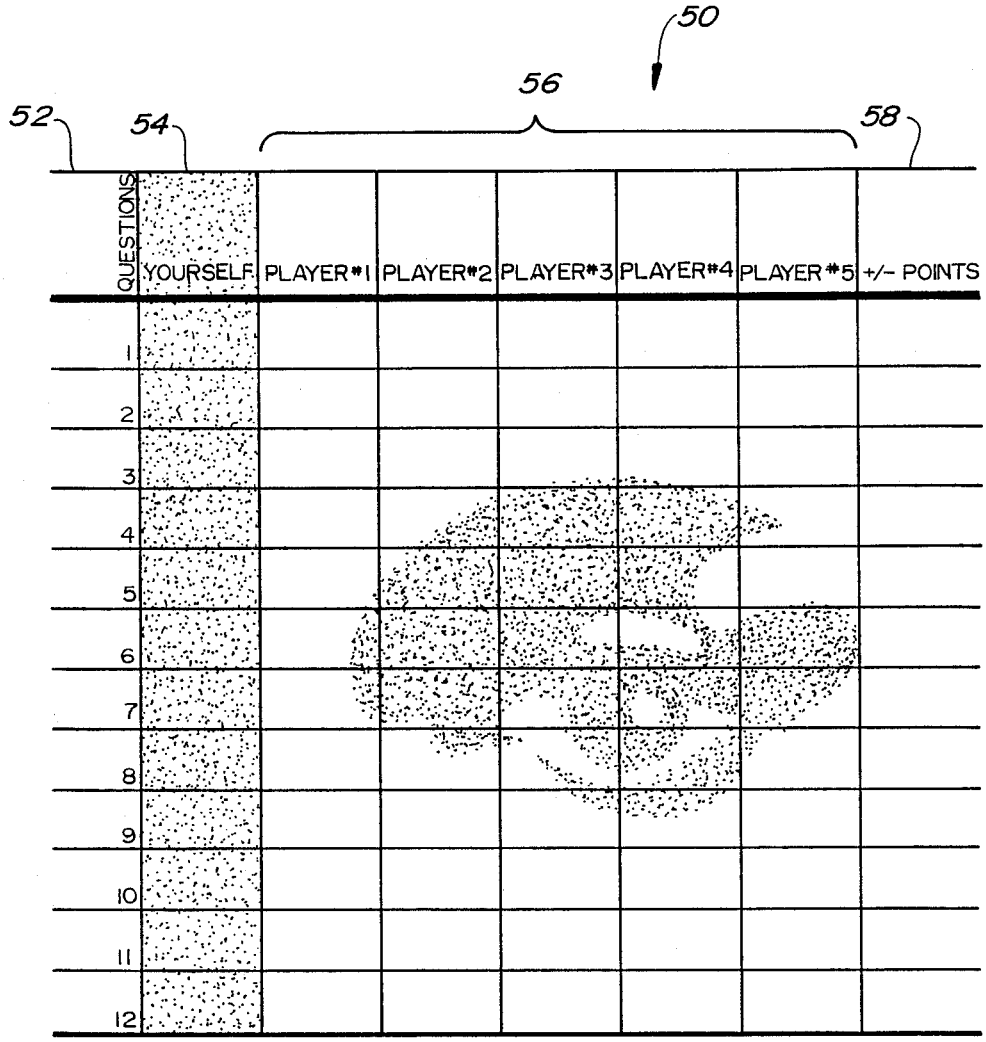
FIG. 3 is a top plan view of the score pad of the game apparatus of this invention.

FIG. 3 is a top plan view of the score pad 50 of the game apparatus of this invention. Score pad 50 includes question number column 52 to identify the number of questions that have been asked, self answer column 54 for the player's entry of his own response to a given question, player answer columns 56 for recordation of the other player's responses to a given question, and point total column 58 for calculation of the number of correct perceptions a player has made about the other player's responses.

The following is a synopsis of the actual rules of play of a preferred embodiment of this game:

PERCEPTIONS

Contents:

You'll find that there are 3 decks of 60 cards each (for a total 180 cards) in Perceptions along with 6 foam game pieces, a cloth game board and a score pad. What's not included are pens or pencils so rush to the other room to grab some before you continue on.

Before you begin:

Got your pen or pencil? Great! Now have each player take a score sheet and write his or her own name in the first shaded column followed by the names of everyone else who's playing (this would all be along the top area as illustrated).

Now place the Perceptions game cloth on a flat surface and smooth out any bumps or wrinkles. Have the players grab a foam game ball and after they're cone squeezing and throwing it at the others, have them begin practicing their "marble shooting" ability on the game cloth. This is crucial for games have been won and lost with a missed roll.

After a few minutes of practice shooting try to restore order. Neatly place the decks of cards in 3 piles. There are 3 categories of questions in Perceptions, each category represented by the cards with burgundy, green or blue lettering. The burgundy cards are the simpler questions, usually requiring a yes-or-no or multiple choice answer. The green cards are a bit more difficult, the questions often placing you in a "what-if" or dream situation. The blue cards, however, usually require the most thought for those questions deal mainly with your personal outlooks and beliefs. The category of question you'll choose is determined by where your foam ball lands on the playing board. If your ball winds up on a burgundy, green or blue area of the board you would draw that respective color card. Land in a gold area and you can draw from any color card. But land in a gray area or shoot your ball off of the board and you lose your turn (now you see why there was that practice session in the beginning).

Playing the Game:

Well you've made it this far and from this point the fun begins. The objective of Perceptions is to find out just how well you know yourself and the people your're playing with. As each question is asked you would write down no only your response but how you feel each of the other players would respond as well.

To determine who goes first, each player shoots his or her ball from one of the colored circles on the board. The player whose ball comes closest to the Perceptions "eye" in the center of the board begins play.

Let's say that your ball came closest and so your're the first player. You would start by again shooting your ball from the nearest circle, trying to land in a burgundy, green, blue or gold area. You would then draw a card from the matching color deck and read the question aloud. Important-your shot must cross at least 3 colored areas or go halfway across the board before it can be counted (failure to do so results in a loss of that turn).

As an example, if your ball landed in a green area you would draw a green card and read the question to the rest of the group. Suppose the question read, "Would you vote for a female president of the United States?" All players would then write on their score sheet how they would personally answer that question and how they think everybody else would answer. Thus if there were 6 players, everyone should have 6 answers on his/her score sheet for that question, his/her own answer plus an answer for each of the other 5 players.

Once the question is read and all of the players have answered, the question card is placed face down in a separate pile (keeping the questions in the same order as asked). The player's ball is cleared and play moves to the next player on the left. Play continues until 12 questions have been drawn and answered.

Scoring:

At the end of the game, the pile of 12 "asked" questions is handed to the next player who then reads the first of the questions to the rest of the group. Players then voice their own answers and score a point for each correct answer on another person (your own answers in the shaded area are not counted as points). Thus if the player next to you said "no" to the question and you had put "no" for that player on your score sheet, you would score a point.

Correct (matching) answers are circled while incorrect answers are simply crossed out. Questions which consist of 2 answers count as 2 points.

The pile of cards is then passed to the next player who reads off the next question and answers are again compared. Play thus continues until all 12 questions have been read and the answers compared. At this time, scores are tallied and the player with the most points wins.

In the event of a tie, a new question is drawn from the blue deck and read aloud. Only the players who are tied, however, would write down their answers for all players. After a given time, all players reveal what they would have answered and the tied players compare their scores.

Bonuses & Penalties:

Life is filled with bonuses and penalties, isn't it? Okay, first the good news. A Bonus point is scored when your ball rolls from one colored circle and lands in another colored circle. This is not impossible but it is difficult to do. Therefore you would not only score a bonus point but you would also get to ask a question from any of the card categories.

The bad news is that there are several Penalties. You lose a point if—once the game begins—you land anywhere in the Perceptions logo square in the center of the scarf. You also lose a point if you change your answer after you heard someone scream it out inadvertently (and this happens quite often). As an example, if the question "Would you vote for a female president of the United States?" came up and the person next to you blurted out, "You'd better believe it!," you could not change your answer to a "yes" if you had already scribbled "no" on your score sheet. On the other hand, if you were patient and hadn't written any answer yet, it is acceptable to then scribble "yes" (unless you have a sneaky suspicion that that person is merely trying to throw you off). The general rule in this game (during the questions, at least) is silence.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A game apparatus comprising:

a playing surface having a perimeter, a plurality of corners, a plurality of playing sections, a center area, a boundary extending generally around said perimeter but interior of said corners, a plurality of section dividing lines, each defining a diminishing-radius curve extending from said boundary towards said center area, said section dividing lines dividing said playing surface into a plurality of playing sections, each of said playing sections bearing indicia indicative of a particular play result;

a plurality of question cards each bearing indicia indicative of only one of more than one level of questions; and at least one game piece conditioned for rolling on said playing surface and coming to rest on only one of said playing sections, thus generating a result indicia for that roll.

2. A game apparatus of claim 1 wherein said question cards bear written questions dealing with a player's personal outlooks and beliefs.

* * * * *